US008342065B2

(12) United States Patent
Shaulov

(10) Patent No.: US 8,342,065 B2
(45) Date of Patent: Jan. 1, 2013

(54) TORCLIP SCREWDRIVER

(76) Inventor: Mike Shaulov, Brooklyn, NY (US)

( * ) Notice: Subject to any disclaimer, the term of this patent is extended or adjusted under 35 U.S.C. 154(b) by 245 days.

(21) Appl. No.: 12/940,496

(22) Filed: Nov. 5, 2010

(65) Prior Publication Data

US 2012/0111158 A1 May 10, 2012

(51) Int. Cl.
*B25B 23/16* (2006.01)
*B43K 23/00* (2006.01)

(52) U.S. Cl. ..... 81/439; 401/131

(58) Field of Classification Search ..... 81/436, 81/439; 7/165; 401/31, 131
See application file for complete search history.

(56) References Cited

U.S. PATENT DOCUMENTS 1,530,905 A * 3/1925 Nance ..... 81/177.6
1,559,097 A * 10/1925 Hill ..... 81/177.2
2,778,396 A * 1/1957 Swain ..... 81/33
3,342,229 A * 9/1967 Janes ..... 81/63.2
4,235,269 A * 11/1980 Kraus ..... 81/438
4,827,812 A * 5/1989 Markovetz ..... 81/439
5,450,775 A * 9/1995 Kozak ..... 81/440
5,904,080 A * 5/1999 Anderson et al. ..... 81/439
6,095,018 A * 8/2000 Schuster ..... 81/177.5
6,233,770 B1 * 5/2001 Garcia ..... 7/165
6,295,904 B1 * 10/2001 Webb ..... 81/492
6,397,709 B1 * 6/2002 Wall ..... 81/440
6,494,121 B1 * 12/2002 Hu ..... 81/439
7,052,128 B1 * 5/2006 Kung-Ping ..... 351/42
7,497,584 B1 * 3/2009 Quittner ..... 362/103
7,909,528 B2 * 3/2011 Brooks et al. ..... 401/131
2002/0170394 A1 * 11/2002 Tsai ..... 81/439
2003/0112624 A1 * 6/2003 Quittner ..... 362/200
2003/0188609 A1 * 10/2003 Crawley ..... 81/439
2006/0130621 A1 * 6/2006 Novak et al. ..... 81/439
2006/0213338 A1 * 9/2006 Yaar ..... 81/490
2006/0233591 A1 * 10/2006 Dietz ..... 401/131
2006/0239754 A1 * 10/2006 Dietz ..... 401/131
2007/0041777 A1 * 2/2007 Dietz ..... 401/131
2008/0028899 A1 * 2/2008 Scott et al. ..... 81/177.7
2008/0101846 A1 * 5/2008 Brooks ..... 401/131

* cited by examiner

*Primary Examiner* — David B Thomas
(74) *Attorney, Agent, or Firm* — Ernesto Garcia

(57) ABSTRACT

A six-in-one multi bit screwdriver that is the size of a pen with a pocket clip to fit the tool in the pocket. Furthermore, the pocket clip pivots 90 to become a handle and contents the traditional screwdriver to a mini ratcheting screwdriver that provides the leverage to turn the most stubborn screw.

13 Claims, 2 Drawing Sheets

TORCLIP SCREWDRIVER

BACKGROUND OF THE INVENTION

1. Field of the Invention

The present invention generally relates to pocket screwdrivers, and more particularly, to pocket ratcheting screwdrivers having multi bits and means of converting a pocket clip to a lever of a mini ratcheting screwdriver for increasing applied torque.

2. Description of Related Art

A standard screwdriver includes a handle rigidly affixed to and axially (i.e., longitudinally) aligned with a shaft forming a head. The head may be of a number of types. In use, an axial force is applied to the screwdriver while also applying torque.

Pocket screwdrivers with multi bits are longstanding within the hand tool art. However, they are not widely used among mechanics and handymen because it applies insufficient torque because of its low leverage in turning the screwdriver around the longitudinal axis.

However, it is highly desirable to have a multi function screwdriver that could be carried in a shirt pocket and can generate enough torque. Because of the sheer number of tools required today it is staggering to find a needed tool and it is expensive to own all of them. Furthermore, it is inconvenient to carry a tool box around or even to carry a large tool around. Often times worker are in a position where they can't readily have access to exchange tools from their tool box. This device will allow the worker to always have a multi bit screwdriver that easily clips on the pocket like a pen.

U.S. Pat. No. 4,827,812 discloses a pocket screwdriver with a torque amplification means in the form of a torque cap that can be placed 90 in a receiving hole on the hollow shaft of the screwdriver. However, the hollow shaft ends are not nut driver sockets that can also have tool bits inserted. Thus, the invention only can have 3 different tips carried by the invention at once. Besides, the screwdriver disclosed in the patent does not have a pocket clip.

WO 2008019026A2 discloses a hand tool with a lever arm for applying torque constructed to fold into the handle assembly. However, the invention can only utilize one tip. Our invention has multi-bits and has a pocket clip to prevent misplacement.

U.S. Pat. No. 5,450,775 discloses a multi-function driving tool that can carry up to six tip heads and utilizes an elongated tube inserted with the head bits on both of its end as a lever arm to provide torque instead of the pocket clip. The pocket clip only serves the function of clipping to the pocket.

U.S. Pat. No. 6,397,709 discloses a hand tool with rotatable arms that can be used with a variety of bits. However this patent did not mention using the openings of the blade or arms that are sized and shaped to allow tool bits to be inserted to be used as nut drivers of different sizes. It does not have a pocket clip either.

The present invention overcomes the shortcomings of the screwdrivers or hand tools disclosed in the related art. The present invention is directed to a pen size, six-in-one multi-function pocket clip screwdriver wherein the pocket clip pivots 90 to become the handle of a mini ratcheting screwdriver giving the user the leverage to turn the most stubborn screw.

SUMMARY OF THE INVENTION

The present invention is directed to a six-in-one screwdriver that is the size of a pen for easy carrying around. The pocket screwdriver has a handle, a hallow shaft, a plurality of tool bits, a pocket clip, and a magnet located at the end of the pocket clip. The pocket clip can be pivoted 90° around the hinge to a position that is substantially perpendicular to the longitudinal axis of the handle. In this configuration the pocket clip becomes the lever of a mini ratcheting screwdriver giving the user the leverage to turn the most stubborn screw. The handle, the hollow shaft and a plurality of double-headed tool bits comprise an elongated member.

The handle is hollow inside and has an opening to receive, hold, and release the hollow shaft with an outside dimension that will fit the open end of the handle. The hollow shaft has nut driver sockets of different sizes on each end. The hollow shaft can be reversibly inserted into the handle.

Both nut driver socket ends of the hollow shaft can also receive, hold and release tool bits that are sized and shaped to fit the openings. The two double-headed bits can both be removed from the end of the hollow shaft, reversed and reinserted to make a different bit tool (bit head) for use. This creates a six (i.e. 4 bit heads and 2 nut driver heads) in one hand tool.

The foregoing has outlined, rather broadly, the preferred feature of the present invention so that those skilled in the art may better understand the detailed description of the invention that follows. Additional features of the invention will be described hereinafter that form the subject of the claims of the invention. Those skilled in the art should appreciate that they can readily use the disclosed conception and specific embodiment as a basis for designing or modifying other structures for carrying out the same purposes of the present invention and that such other structures do not depart from the spirit and scope of the invention in its broadest form.

BRIEF DESCRIPTION OF THE DRAWINGS

Other aspects, features, and advantages of the present invention will become more fully apparent from the following detailed description, the appended claim, and the accompanying drawings in which similar elements are given similar reference numerals.

DESCRIPTION OF THE PREFERRED EMBODIMENT

Figure 1:
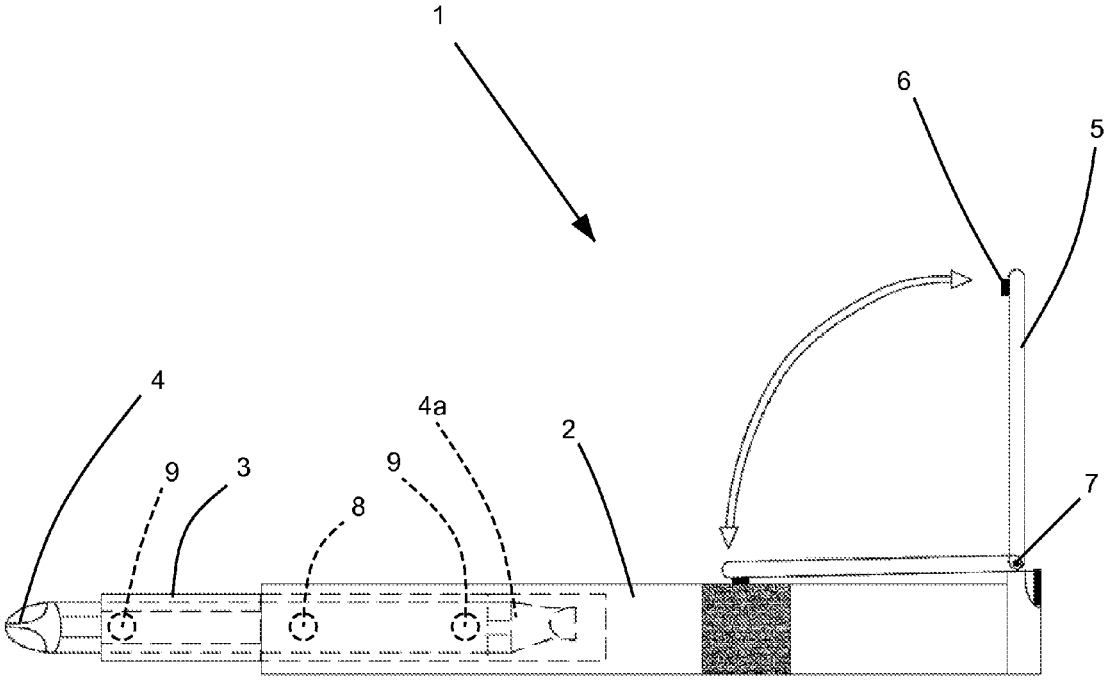
FIG.1 is a perspective view of the torclip screwdriver embodying the present invention.
Figure 2:
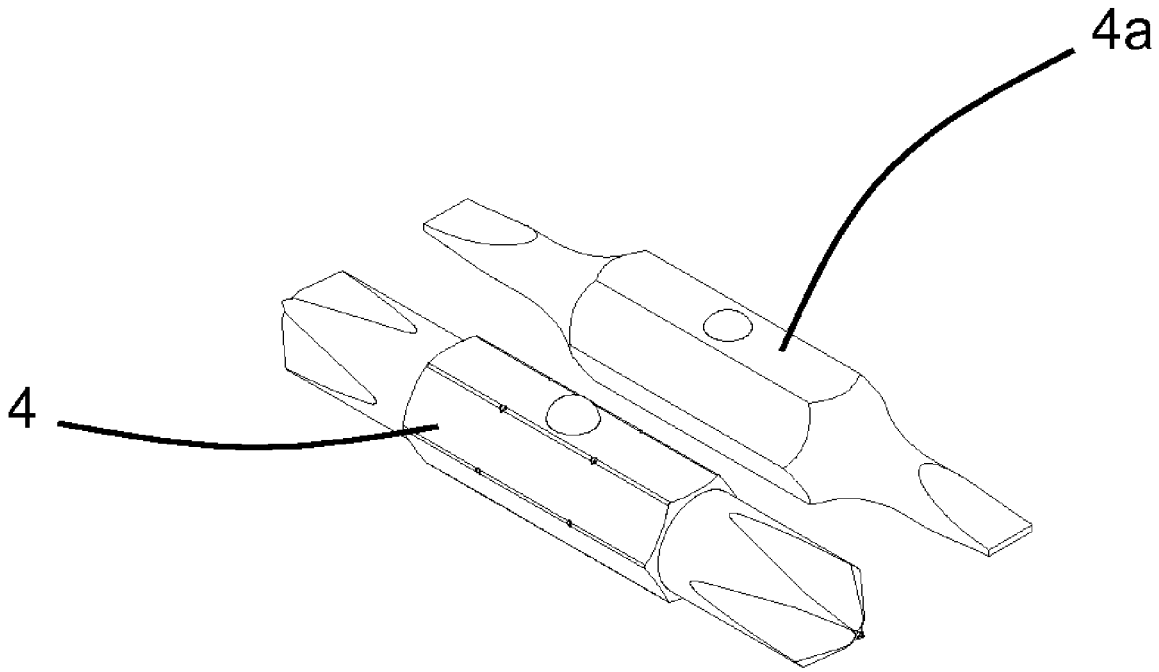
FIG.2 is a perspective view of the double-headed tool bits that may be selectively and reversibly inserted into the torclip screwdriver.

In the illustration given, the reference numeral 1 designates the pocket screwdriver that is the size of a pen for easy carrying around. It fits and clips on the pocket when not in use, preventing misplacement. The pocket screwdriver 1 has a handle 2, a hallow shaft 3, a plurality of tool bits 4, 4*a*, a pocket clip 5, and a magnet 6 located at the end of the pocket clip. The pocket clip is attached to the closed end of the handle through a hinge 7. The pocket clip can be pivoted 90° around the hinge to a position that is substantially perpendicular to the longitudinal axis of the handle. In this configuration the pocket clip becomes the lever of a mini ratcheting screwdriver giving the user the leverage to turn the most stubborn screw. Mechanisms known now or later can be used to hingedly connect pocket clip to the handle. The clip is preferably constructed of steel, but other suitable materials can be used. The magnet is magnetically engaged to a metallic portion on said handle.

The handle can be any shape or size that provides the function of a handle. Preferably, the handle includes ribs that provide grip and is contoured for the hand to grip. The handle preferably constructed of plastic, but can be metal or any other suitable material. The handle is hollow inside and has an open end to receive, hold, and release the hollow shaft with an outside dimension that will fit the open end of the handle. The hollow shaft has nut driver sockets of different sizes on each end. The hollow shaft can be reversibly inserted into the handle. The advantage of a deep cavity inside the shaft is for the purpose of accommodating a long shank onto which a nut is threaded.

The hollow shaft 3 can be retained in the cavity of the handle through a detent ball 8 at the midpoint on the surface of the hollow shaft 3. Or this can be accomplished by any retaining or releasing mechanism known now or in the future which is suited to this purpose. The handle can allow for removal of hollow shaft by hand (e.g., the user can pull the hollow shaft out of the handle) or the handle can provide for any other mechanism of release known now or in the future suited to this purpose. The hollow shaft can be metal or any other material suitable to serve the function of a hollow shaft. The handle and the hollow shaft preferably have a substantially circular cross-section, but can have other cross sectional shapes, e.g., rectangular, triangular, oval or other-shaped cross sections.

Both nut driver socket ends of the hollow shaft can also receive, hold and release tool bits that are sized and shaped to fit the openings. The tool bits 4, 4*a* will retain in the hollow shaft through a detent ball 9 at the midpoint of the tool bits. Both of the two double-headed bits having a hexagonal shaft can be removed from the end of the hollow shaft, reversed and reinserted to make a different tool bit heads for use. This creates a six (i.e. 4 bit heads and 2 nut driver heads) in one hand tool. The nut drivers are preferably ¼" and 3⁄16". The reversible tool bits are preferably Phillips head screwdriver 1 and 2 on one tool bit 4 and a flat ¼" and 3⁄16" on the other tool bit 4*a*.

While there have been shown and described and pointed out the fundamental novel features of the invention as applied to the preferred embodiments, it will be understood that the foregoing is considered as illustrative only of the principles of the invention and not intended to be exhaustive or to limit the invention to the precise forms disclosed. Obvious modifications or variations are possible in light of the above teachings. The embodiments discussed were chosen and described to provide the best illustration of the principles of the invention and its practical application to enable one of ordinary skill in the art to utilize the invention in various embodiments and with various modifications as are suited to the particular use contemplated All such modifications and variations are within the scope of the invention as determined by the appended claims when interpreted in accordance with the breadth to which they are entitled.

What is claimed is:

1. A screwdriver comprising:

(a) an elongated member; and (b) a pocket clip having a magnet attached through a hinge to a closed end of the elongated member and pivotable around the hinge to a position that is perpendicular to the longitudinal axis of the elongated member.

2. The screwdriver of claim 1 wherein the elongated member comprising:

(a handle having a cavity and an open end that is opposite to the closed end of the elongated member;

(b) a hollow shaft having a nut driver socket on both ends; and (c) a plurality of double-headed tool bits respectively inserted to both nut driver socket ends of the hollow shaft.

3. The screwdriver of claim 2 wherein the hollow shaft being retained in the cavity of the handle through a detent ball at the midpoint on the surface of the hollow shaft.

4. The screwdriver of claim 2 wherein the tool bits respectively being retained in the nut driver socket ends of the hollow shaft through a detent ball at the midpoint on the surface of the tool bits.

5. The screwdriver of claim 2 wherein the nut driver sockets are of different sizes.

6. The screwdriver of claim 2 wherein the tool bits are Phillips head screwdriver 1 and 2 on one tool bit and a flat ¼" and 3⁄16" on the other tool bit.

7. The screwdriver of claim 1, wherein the pocket clip is a lever of a mini ratcheting screwdriver.

8. A screwdriver comprising:

(a) an elongated member; and (b) a pocket clip having a magnet attached through a hinge to a closed end of the elongated member and pivotable around the hinge to a position that is perpendicular to the longitudinal axis of the elongated member;

wherein the elongated member comprising:

i. a handle having a cavity and an open end that is opposite to the closed end of the elongated member; and ii. a hollow shaft having a nut driver socket on both ends, inserted to the handle.

9. The screwdriver of claim 8 wherein the hollow shaft being retained in the cavity of the handle through a detent ball at the midpoint on the surface of the hollow shaft.

10. The screwdriver of claim 8 wherein the double-headed tool bits being retained in the nut driver socket ends of the hollow shaft through a detent ball at the midpoint on the surface of the tool bits.

11. The screwdriver of claim 10 wherein the tool bits are Phillips head screwdriver 1 and 2 on one tool bit and a flat ¼" and 3⁄16" on the other tool bit.

12. The screwdriver of claim 8 wherein the nut driver sockets are of different sizes.

13. The screwdriver of claim 8, wherein the pocket clip is a lever of a mini ratcheting screwdriver.

* * * * *